United States Patent [19]

Elsel

[11] 4,379,275

[45] Apr. 5, 1983

[54] DEVICE FOR TRANSMITTING LARGE FORCES

[75] Inventor: Werner Elsel, Erlangen, Fed. Rep. of Germany

[73] Assignee: Siemens Aktiengesellschaft, Munich, Fed. Rep. of Germany

[21] Appl. No.: 281,936

[22] Filed: Jul. 10, 1981

[30] Foreign Application Priority Data

Jul. 21, 1980 [DE] Fed. Rep. of Germany ..... 3027605

[51] Int. Cl.[3] ..... H01F 7/22

[52] U.S. Cl. ..... 335/216; 174/15 CA

[58] Field of Search ..... 335/216; 174/15 CA, 174/17 VA

[56] References Cited

U.S. PATENT DOCUMENTS

| | | | |
|---|---|---|---|
| 3,980,981 | 9/1976 | Boom et al. | 335/216 |
| 3,996,545 | 12/1976 | Elsel et al. | 335/216 X |
| 4,066,991 | 1/1978 | Marston et al. | 335/216 |

OTHER PUBLICATIONS

"IEEE TRANSACTIONS ON MAGNETICS", vol. MAG-11, No. 2, Mar. 1975, pp. 475–488.

*Primary Examiner*—George Harris

*Attorney, Agent, or Firm*—Kenyon & Kenyon

[57] ABSTRACT

A device for transmitting large forces between a superconducting magnet winding cooled to a very low temperature and an abutment which takes up the forces and is at a higher temperature level, particularly of an energy storage device, includes support bodies which are arranged one behind the other in the direction of the force transmission and are subdivided thermally at least partially by a metal sheet serving as a heat shield in which a high buckling stiffness with only small thermal losses due to heat transfer is obtained by using at least one box shaped hollow support element as the support body and by keeping the sheet metal of the heat shield at a predetermined intermediate temperature by means of a coolant conducted through at least one cooling tube connected thereto.

9 Claims, 6 Drawing Figures

DEVICE FOR TRANSMITTING LARGE FORCES

BACKGROUND OF THE INVENTION

This invention relates to a device for transmitting large forces between a superconducting magnet winding cooled to a very low temperature and an abutment which is at a higher temperature level and takes up the forces.

A device for transmitting large forces from a super conducting magnet winding forming an energy storage device, the supports of which contain several support members which are arranged one behind the other in the direction of the force transmission and are thermally divided by a metal sheet serving as a heat shield, is described, for instance, in U.S. Pat. No. 3,980,981.

Such force transmission devices are required particularly for inductive superconducting energy storage devices. The great advantage of such storage devices is seen in the fact that with them, energies in the order of $10^{12}$ joule or more can be stored in a relatively small volume, and energy densities of about 10 joule/cm$^3$ can be obtained with magnetic flux densities of about 5 tesla or more. Such high flux densities can be produced in magnet windings economically only by means of so-called technical Type II superconductors such as niobium-titanium (Nb-Ti), niobium-tin ($Nb_3Sn$) or vandium-gallium ($V_3Ga$). Similar energy storage devices generally contain a number of coaxial solenoids of these conductors into which the electric energy is fed during low load periods of many hours via an inverter from a connected power supply network. During peak load times, the required energy can then be given off to the network again over a period of minutes or hours.

In accordance with one proposal for a corresponding superconducting energy storage device, with which supposedly several gigawatt hours can be stored, three magnet windings of stabilized niobium-titanium superconductors are provided. Each of the windings should have a diameter of between 120 and 150 m, and is 5 m wide and 8 to 10 m high. They are to be fabricated in situ in tunnels which are driven into the rock ("IEE Transactions on Magnetics", vol. MAG 11, no. 2, March 1975, pages 475 to 488).

The forces emanating from the superconducting winding of such a gigawatt magnetic storage device, such as Lorentz forces, are, for instance, on the order of magnitude of $10^{11}$ newton. It must be possible to safely transmit these very large forces using a force transmission device between the superconducting magnet winding and an outer abutment which takes up the force and for which, especially for cost reasons, natural rock is provided. In addition, it is a prime requirement for such a force transmission device that the thermal losses due to solid body heat inflow through it into the windings which are at a very low temperature be kept as low as possible. For, the economic feasibility of a superconducting energy storage device is determined in particular also by these heat losses.

These requirements are supposedly also met by the force transmitting device described in U.S. Pat. No. 3,980,981. According to one embodiment, this device contains columnar supports which extend radially outward with respect to the axis of a superconducting magnet winding associated therewith approximately in the direction of the force transmission. These supports are furthermore mutually guyed so as to ensure sufficient strength (FIG. 1). Also, pairs of supports engage, at their end facing the magnet winding, a common support point so that they represent the two legs of an A shaped support arrangement. These supports are furthermore held in a firm mutual position by stiffening elements extending transversely to the bracing direction (FIG. 3.) In the known force transmission devices also provided, approximately concentrically about the magnet winding, are sheet-like thermal radiation shields which consist of metallic surfaces and superinsulation. These shields subdivide the supports thermally in the direction of the force transmission.

It has been found, however, that these known force transmitting devices, especially also those with an A shaped support have only relatively little buckling strength. In order to prevent buckling of the support under load, the supports of the known force transmission devices must therefore have a sufficiently large material cross section. This, however, leads to correspondingly large losses due to heat inflow to the parts cooled to the lowest temperature of the storage device and therefore, to a reduction of its efficiency.

It is therefore an object of the present invention to develop a force transmission device of the type mentioned at the outset in such a manner that with it, the large forces occurring in a superconducting energy storage device can be safely transmitted to the outside, and the thermal losses due to solid body heat inflow via its support cross section are nevertheless relatively small.

SUMMARY OF THE INVENTION

According to the present invention, this problem is solved by providing at least one box shaped hollow support element as the support body, and by holding the sheet metal of the heat shield at a predetermined intermediate temperature, in a manner known per se, by means of a coolant conducted through at least one cooling tube thermally connected thereto.

The advantages of this design of the support device are seen particularly in the fact that its support elements can be prefabricated without difficulty, for instance on numerically controlled winding machines and can then be assembled with the cooling baffles of the heat shields in a simple manner to form the overall support. Its heat conducting support cross section, which is designed in view of the permissible compression, tensile and shear stresses is then relatively small. In addition, a large part of the heat flow transmitted via the support can be removed at the heat shields by an appropriate coolant. The thermal losses due to solid body heat inflow can thus be limited to relatively small amounts. Since, furthermore, large area connections, for instance by cementing, can be provided between the individual parts of the support, large shear forces can also be transmitted via the supports.

DETAILED DESCRIPTION

Figure 1:
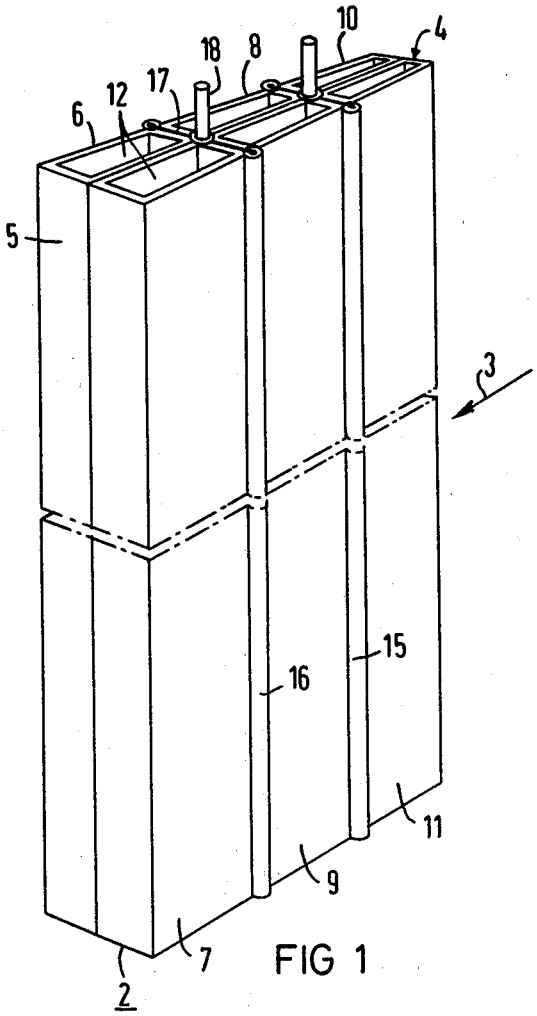
FIG. 1 is a schematic illustration of an embodiment of a support of a force transmitting device according to the present invention.

The support 2 which is shown in an oblique view in FIG. 1 is to serve for the transmission of forces between a magnet winding, which is to be cooled to a very low temperature but is not shown in the figure, of an energy storage device and an abutment, not shown, which is approximately at ambient temperature and takes up the forces. This abutment which takes up forces may, in particular, be rock. The direction of force transmission is at least approximately radial with respect to an axis associated with the magnet winding. In an energy storage device, however, the support is stressed not only by force components in this direction, and therefore radially but other force components also occur. The total force which acts on the support in operation and is indicated by an arrow 3, therefore does not act necessarily in the radial force transmission direction but can also form an angle with this direction. The side 4 of the support resting against the magnet winding is at the very low temperature of, say, 1.8 K., while its opposite side 5 resting against the abutment is approximately at ambient temperature of, for instance, 300 K. In a cross section parallel to the direction of the force transmission, the support 2 of the force transmission device is of trapezoidal shape, the base of the trapezoid being formed by the side 5 and the opposite, top side by the side 4. It is composed of three support elements which are arranged one behind the other in the force transmission direction and are formed by pairs of support elements 6 and 7; 8 and 9; and 10 and 11, respectively, with corresponding cross-sectional shapes, and of which one element, for instance, element 7, is illustrated in detail in FIG. 2. According to the present invention, box-like hollow bodies are provided as the support elements, the continuous cavities 12 of which extend perpendicular to the force transmission direction. The width $b_1$ of the trapezoidal cross section is larger on the side of the abutment which takes up the forces than the width $b_2$ on the cold side facing the magnet coil. The dimension h of the support element perpendicular to the force transmission direction and perpendicular with respect to the trapezoidal cross-sectional areas is substantially larger than the widths $b_1$ and $b_2$ or also the magnitude a of the sides forming the legs of the trapezoid.

Figure 2:
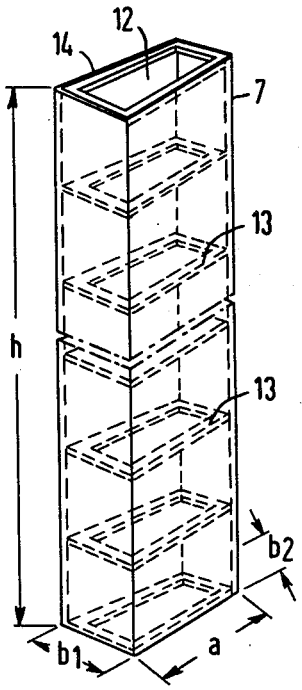

As can be seen further from the presentation in FIG. 2, the individual hollow box-shaped support elements can advantageously also be provided with similar trapezoidal stiffening ribs 13 which are fastened in form locking and frame-like manner to the inside walls of the hollow bodies forming the support elements. These stiffening ribs prevent bulging of the hollow bodies under compression load.

As material for the support elements 6 to 11 as well as for the stiffening ribs 13 a fiberglass reinforced plastic, especially an epoxy matrix with embedded fiberglass strands in advantageously used. Optionally, a matrix of polyester can also be used.

Within the support 2, bars identical support elements 6 and 7; 8 and 9; and 10 and 11, respectively, are joined together in a form locking manner at one of their broad sides to form a strong support body. Thus, the support elements 6 and 7 are joined together over a large area on their side 14 representing a leg of the trapezoid. The joint between the support elements can advantageously be made by cementing.

Figure 3:
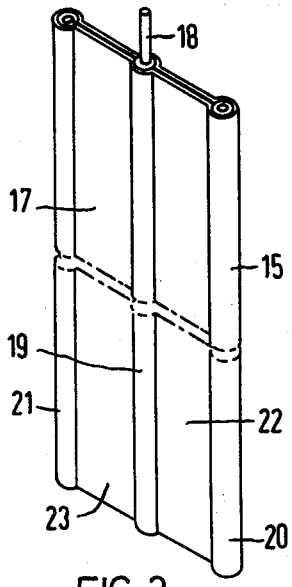
FIGS. 2 and 3 illustrate parts of this support in greater detail.

The support 2 of the force transmitting device advantageously contains individual heat shields which are kept at predetermined, constant temperature levels in a manner known per se. According to the embodiment shown in FIG. 1, two heat shields 15 and 16 are provided which are kept, for instance, by one or more coolants, at a temperature of about 10 K. and 70 K., respectively. These heat shields are arranged between the pairs of support elements 6 and 7; 8 and 9; and 10 and 11. The design of these heat shields, for instance, the heat shield 15 can be seen in detail in FIG. 3. The shield consists, for instance, of a folded, flat, double sheet of metal 17 of a highly heat conducting material such as copper which encloses along its centerline, a cooling tube 18, through which a coolant with predetermined temperature can be conducted. The bead 19 formed by the coolant tube 18 along the center line of the heat shield 15 just fills the corner-shaped hollow space between the long edges of adjacent support elements within the support 2, so that adjacent pairs of support elements can make contact with the heat shields over a large area. The two outer beads 20 and 21 of the heat shields must therefore be located outside the connecting planes 22 and 23 between the heat shields and the support elements. The cooling baffles of the heat shields can advantageously be wrapped with fiberglass reinforced plastic, so that in the assembly of the support 2 from the individual pairs of support elements and the heat shields, the cooling baffles can be easily cemented with sufficient adhesion to the narrow side of the pairs of support elements.

Figure 4:
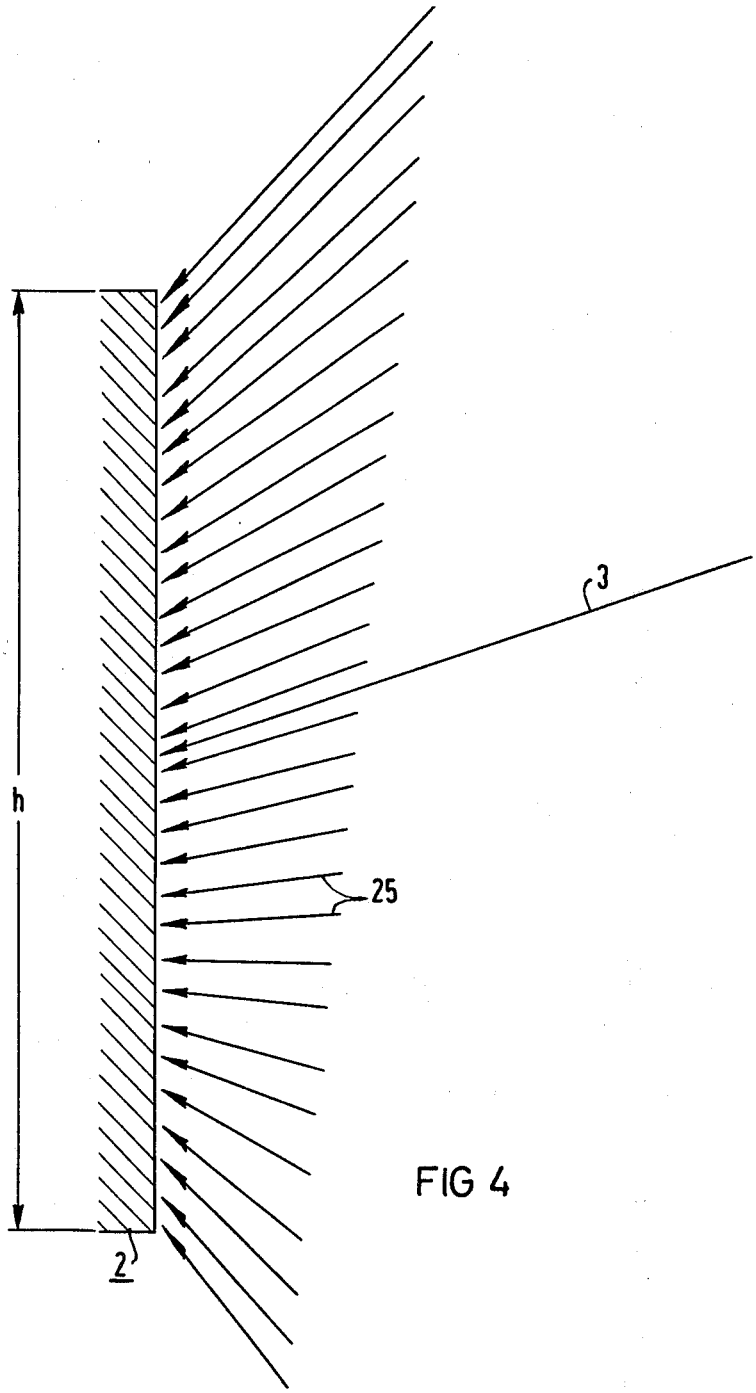
FIG. 4 shows a typical force loading of such a support.

According to one actual embodiment of the support 2 shown in FIG. 1 made of fiberglass reinforced epoxy, the overall support has a height h of about 3.8 m in the direction perpendicular to the direction of the force transmission. On the room temperature side 5, it is about 40 cm wide, i.e., the corresponding narrow sides of the support elements 10 and 11 each have a width $b_2$ of about 10 cm. The length in the force transmission direction is about 1.2 m, the dimension a of the wide sides 14 of the individual support elements being about 40 cm in the force transmission direction. With such a support, the forces indicated in FIG. 4 can be transmitted without the danger of buckling of the support. The forces indicated by arrows 25, which act on the support 2 shown in the figure in a side view, are typical for an energy storage device with superconducting magnet windings of the order of magnitude mentioned at the outset. The total force indicated by an arrow 3, as in FIG. 1, can be, for instance $2\times10^7$ newton, while the individual force components illustrated by arrows 25 are approximately between $5\times10^5$ and $1.5\times10^6$ newton.

Figure 5:
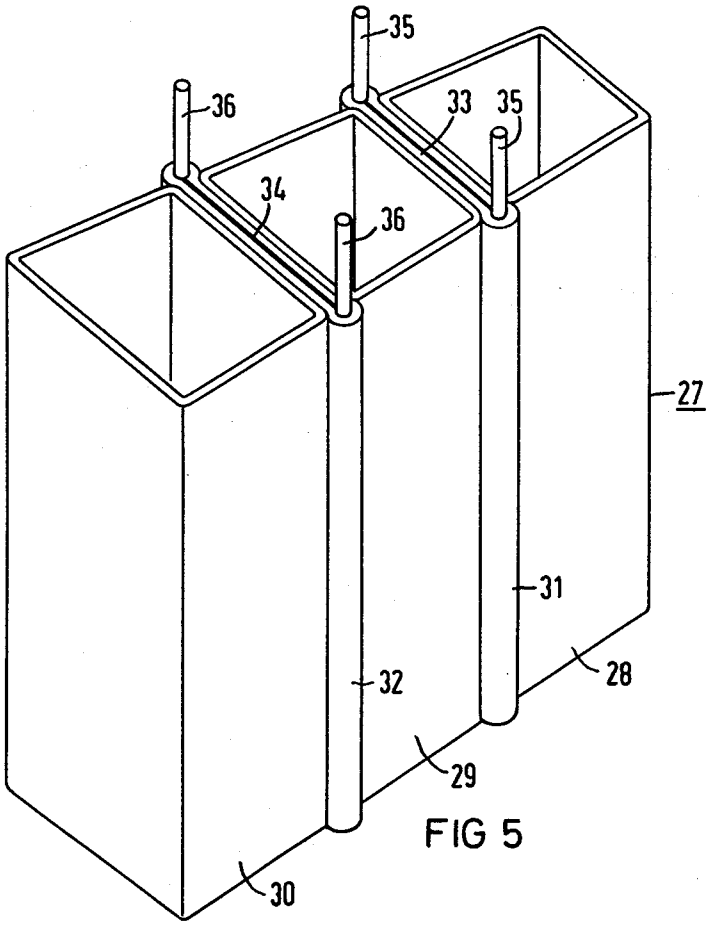

In accordance with the embodiment of FIG. 1 it was assumed that the supports of the force transmission device according to the present invention always contains pairs of support elements which are separated from each other by heat shields. According to the embodiment of a support 27 shown in FIG. 5 in an oblique view, however, its support bodies may also be only single support elements 28, 29 and 30 which are arranged one behind the other in the force transmission direction. Each of these support elements consists of a box shaped hollow body with trapezoidal or also rectangular cross section and are separated from each other by heat shields 31 and 32. In this embodiment, the cooling tubes 35 and 36, which are connected to the metal sheets 33 and 34 of these heat shields are advantageously run outside of the support 27 in order to ensure large-area and cement contact of the individual support elements and the cooling sheets. According to the embodiment shown in this figure, two cooling tubes 35 and 36 are provided, a coolant with a temperature of, for instance, 10 K. being conducted through the tubes 35 and a coolant with a temperature of, for instance, 70 K. being conducted through the coolant tubes 36.

Figure 6:
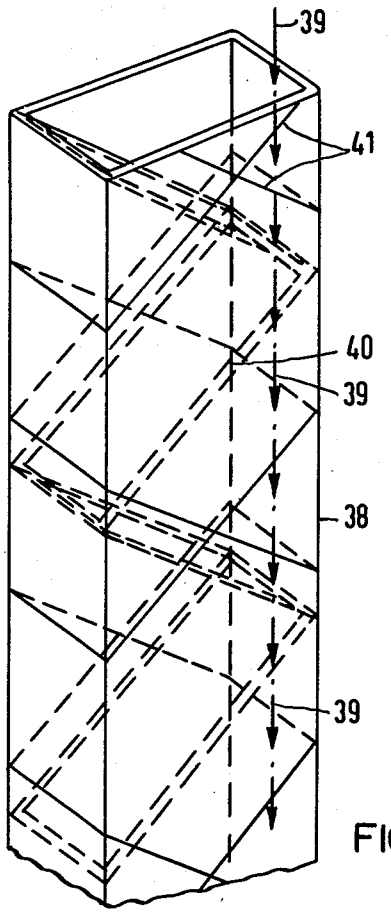
FIGS. 5 and 6 show further possible embodiments of supports of a force transmitting device according to the present invention and of its support elements.

Because the supports of the force transmission device according to the present invention are assembled of individual support elements, the supports can be adapted to the forces acting thereon to a large degree. These forces are not only compression forces but also tensile and sheer forces. Thus, according to the embodiment shown in FIG. 6 in an oblique view, one support element 38 of the support of a force transmission device according to the present invention support can also be adapted to a shear load. The shear force components occurring in this connection are indicated by individual arrows 39. If the support elements are loaded in this manner, their box like hollow body is advantageously provided with stiffening ribs 40 which are attached to the inside walls of the hollow body at an angle with respect to the direction of the forces. As may further be seen from the figure, the fiberglass strands 41 which stiffen the matrix material, for instance, the epoxy or polyester material, can also correspondingly be arranged at an angle in the walls of the hollow body.

What is claimed is:

1. In a device for transmitting large forces between a superconducting magnet winding which is cooled to a very low temperature, and an abutment which takes up the forces and is at a higher temperature level, especially of an energy storage device, including several support bodies which are arranged one behind the other in the direction of the force transmission and are thermally subdivided by a metal sheet serving as a heat shield, the improvement comprising at least one box shaped hollow support element being provided as each support body, and at least one cooling tube thermally connected to the metal sheet of the heat shield for keeping said metal sheet at a predetermined intermediate temperature using a coolant conducted therethrough.

2. The improvement according to claim 1, wherein said support elements are of elongated shape perpendicular to the direction of the force transmission, and have cavities of which extend in this direction.

3. The improvement according to claim 1, wherein the support elements have a rectangular or trapezoidal cross sectional area over a section parallel to the direction of the force transmission.

4. The improvement according to claim 1, and further including stiffening elements attached within the hollow support elements.

5. The improvement according to claim 4, wherein said support elements and stiffening elements are made of fiberglass reinforced plastic.

6. The improvement according to claim 1 wherein said support elements are made of fiberglass reinforced epoxy.

7. The improvement according to claim 4 wherein said support elements are made of fiber glass reinforced epoxy.

8. The improvement according to claim 1 and further including cooling baffles wrapped with fiberglass reinforced plastic forming said heat shields.

9. The improvement according to claim 1 wherein parts of the supports are cemented to each other over a large area.

* * * * *